US008651488B2

(12) United States Patent
Mulholland

(10) Patent No.: US 8,651,488 B2
(45) Date of Patent: Feb. 18, 2014

(54) THREE DIMENSIONAL GAME DEVICE

(76) Inventor: Steve Mulholland, Rockville, MD (US)

( * ) Notice: Subject to any disclaimer, the term of this patent is extended or adjusted under 35 U.S.C. 154(b) by 0 days.

(21) Appl. No.: 13/461,926

(22) Filed: May 2, 2012

(65) Prior Publication Data

US 2012/0280449 A1 Nov. 8, 2012

Related U.S. Application Data

(60) Provisional application No. 61/482,270, filed on May 4, 2011.

(51) Int. Cl.
*A63F 9/08* (2006.01)

(52) U.S. Cl.
USPC ..... 273/153 S; 273/153 R

(58) Field of Classification Search
USPC ..... 273/153 S, 155, 153 R, 157 R
See application file for complete search history.

(56) References Cited

U.S. PATENT DOCUMENTS

| | | | | | |
|---|---|---|---|---|---|
| 3,845,959 | A * | 11/1974 | Kosarek | 273/153 S |
| 4,424,971 | A * | 1/1984 | Clark | 273/153 S |
| 4,548,411 | A * | 10/1985 | Seidman | 273/153 R |
| 4,881,738 | A * | 11/1989 | Ayers | 273/153 S |
| 5,301,943 | A * | 4/1994 | Asztalos | 273/153 S |
| 5,370,394 | A * | 12/1994 | Huncaga | 273/153 S |
| 5,433,448 | A | 7/1995 | Raphael et al. | |
| 5,449,175 | A * | 9/1995 | Nagy et al. | 273/153 S |
| 5,628,512 | A * | 5/1997 | Chan | 273/153 S |
| 6,386,540 | B1 * | 5/2002 | Stevkovski | 273/153 S |
| 6,394,452 | B1 | 5/2002 | Dunne | |
| 6,773,011 | B1 * | 8/2004 | Rom | 273/153 S |
| 6,883,802 | B2 * | 4/2005 | Rom | 273/153 S |
| 2011/0248443 | A1 * | 10/2011 | Artsiely | 273/153 S |

* cited by examiner

*Primary Examiner* — Steven Wong
(74) *Attorney, Agent, or Firm* — Capitol City TechLaw

(57) ABSTRACT

A three-dimensional game device may include selection units that are located at the corners, edges and sides of a body member, thereby creating strategic lines of selectable positions extending in three dimensions across the junction of at least two surfaces of the device.

14 Claims, 5 Drawing Sheets

THREE DIMENSIONAL GAME DEVICE

CROSS REFERENCE TO RELATED APPLICATIONS

This US non-provisional application claims priority under 35 USC 119(e) to U.S. Provisional Application No. 61/482,270 filed on May 4, 2011, the content of which is incorporated herein in its entirety by reference.

BACKGROUND

1. Field

The disclosure relates in general to games, and more particularly to a three dimensional ("3D") game device for playing tic-tac-toe, for example.

2. Description of Related Art 3D games are known in this art. For example, U.S. Pat. No. 6,394,452 discloses a tic-tac-toe game including a cubic game body with multiple anchorage points to receive loose game pieces. The anchorage points are accessible from a plurality of the game body sides enabling play on multiple sides simultaneously. Additionally, U.S. Pat. No. 5,433,448 discloses a 3D tic-tac-toe game in the form of a lattice-like cubicle structure with a plurality of mating cube pieces that insert by attachment means into the lattice structure.

Although conventional games are generally thought to be acceptable (e.g., by adding to the excitement of playing tic-tac-toe on a 3D multi-surface device), they are not without shortcomings. For example, according to convention, the games are equipped with numerous detached game pieces which are placed on the game body during play. Utilizing such devices typically requires organized means or surroundings to manage the cumbersome task of handling multiple attachment pieces during game set-up, play and storage. These difficulties are multiplied for players in mobile settings, especially those players of limited fine motor skills (e.g., young, old, blind, etc.). Further, it is not uncommon to misplace or lose detached game pieces, rendering the game unplayable until replacement parts are procured.

SUMMARY

According to example embodiments, a 3D game permits players to pass the game freely and rotate it during the course of play. Play can be made on all surfaces of the grid lattice-structure body in successive moves allowing many different permutations of the game. Contrary to conventional 3D game units, the example embodiments disclosed herein provide a simplified form of such a game device as to function without the need of attachable parts. To this end, the 3D game has operable parts that are captured within the device body member, without loose or detached game pieces.

The body member may be of any suitable shape and size. The exposed faces may thus be of triangular, square, trapezium, pentagon, hexagon, octagon or other shape. However, it is preferred (but not required) that the surfaces be of equilateral shape, notably square, pentagon, hexagon, or octagon shape so that the body presents a series of uniform surfaces and has symmetry in all three axes so that the game can be played with the game body in any orientation. Preferably, the body is a right pyramid, a cube or a right octahedron or dodecahedron.

For convenience, an example embodiment will be described in terms of a cube body member. Such a body member has six exposed faces and preferably, all six faces are available for use in playing the game. However, if desired one face may be excluded as being the base face upon which the cube rests and, as such is not an exposed face for the purposes of playing the game as described below. Each face presents a right square surface which intersects with two adjacent faces to form a corner of the cube. That corner is an apex of the body member and there are eight such apices to the cube. Two adjacent surfaces intersect along the lines linking each at the apices to an adjacent apex to form the side walls of the cube and each cube has six side walls, including the top and bottom walls of the cube. Each wall can be of any suitable size and color, but will typically be 2" to 5" square. For fabrication or aesthetic purposes the walls may be dished inwardly or outwardly. For convenience, the example embodiments will be described hereinafter in terms of a cube having substantially flat wall surfaces.

The exposed surfaces or shell walls can be of a die cast, milled, extruded or other molded plastic or of a machined metal. The cube may be comprised of an inner support frame and outer exposed cube body made by linking together outer shell wall panels of a suitable material to form the cube shell walls. If desired, such an outer cube shell can be made by snap fitting the wall panels to one another using suitable securing mechanisms along each edge of the panel, and (or) by means of a stem or cup extending normal to the plane of the panel and engaging with a receptor on the inner support frame.

The body member is provided with player selection units at the loci points described above. The selection unit may take the form of a rotating sphere exposed through the cube shell walls. Circular apertures in the shell wall can be aligned to expose an operable portion of the rotating sphere selection unit. The selection unit can be rotated to reveal one of three selection labels. By way of example only, the selection choices will be referred to as "X", "O", and "N" (neutral). Each selection choice can be restrained from rotating out of position with internal detent means, and later re-positioned with suitable dislodging force.

The above and other features, including various and novel details of construction and combinations of parts will be more particularly described with reference to the accompanying drawings. It will be understood that the details of the example embodiments are shown by way of illustration only and not as limitations of the invention. The principles and features of this invention may be employed in varied and numerous embodiments without departing from the scope of the invention.

DESCRIPTION OF EXAMPLE, NON-LIMITING EMBODIMENTS

With reference to FIGS. 1-4, the 3D game 10 has six equally proportioned square sides 12 forming a polygonal cube. Exposed to view on each side 12 is a plurality of rotating sphere selector units 14 arranged in a grid array.

Figure 3:
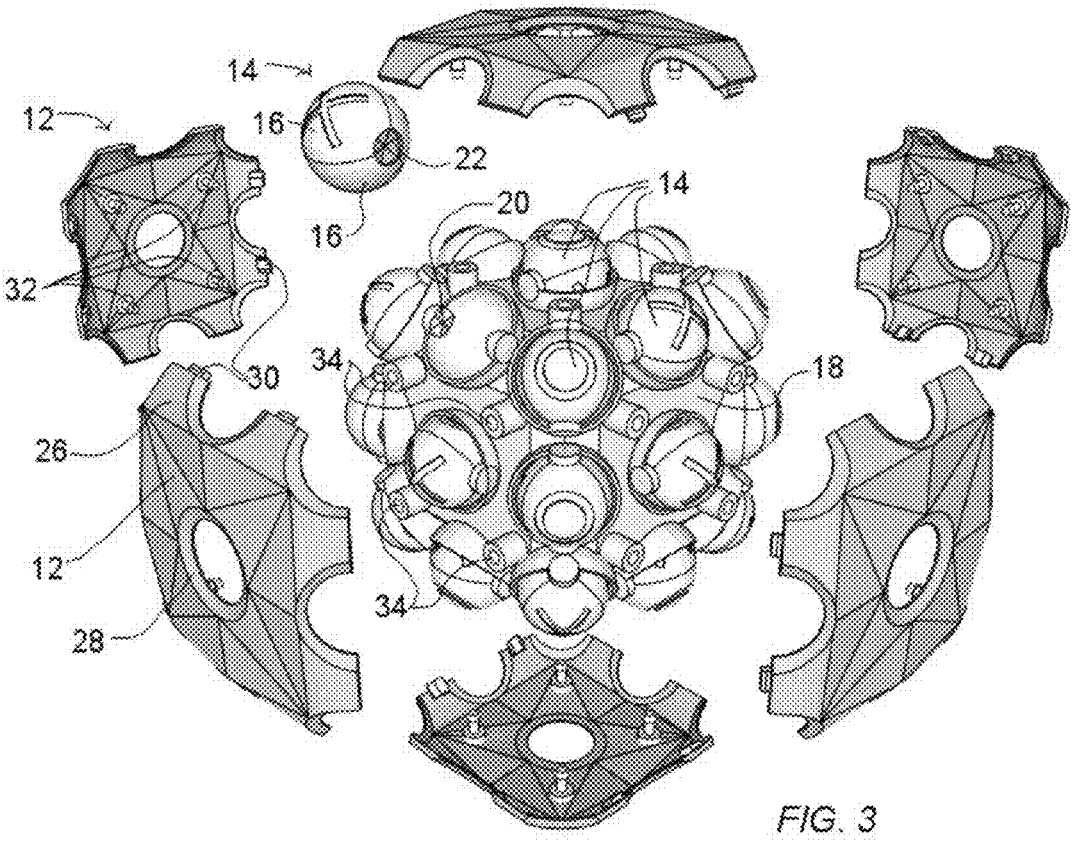
FIG. 3 is an exploded perspective view of outer shell wall panels, an inner frame body, and selection units in accordance with an example, non-limiting embodiment of the present invention.
Figure 4:
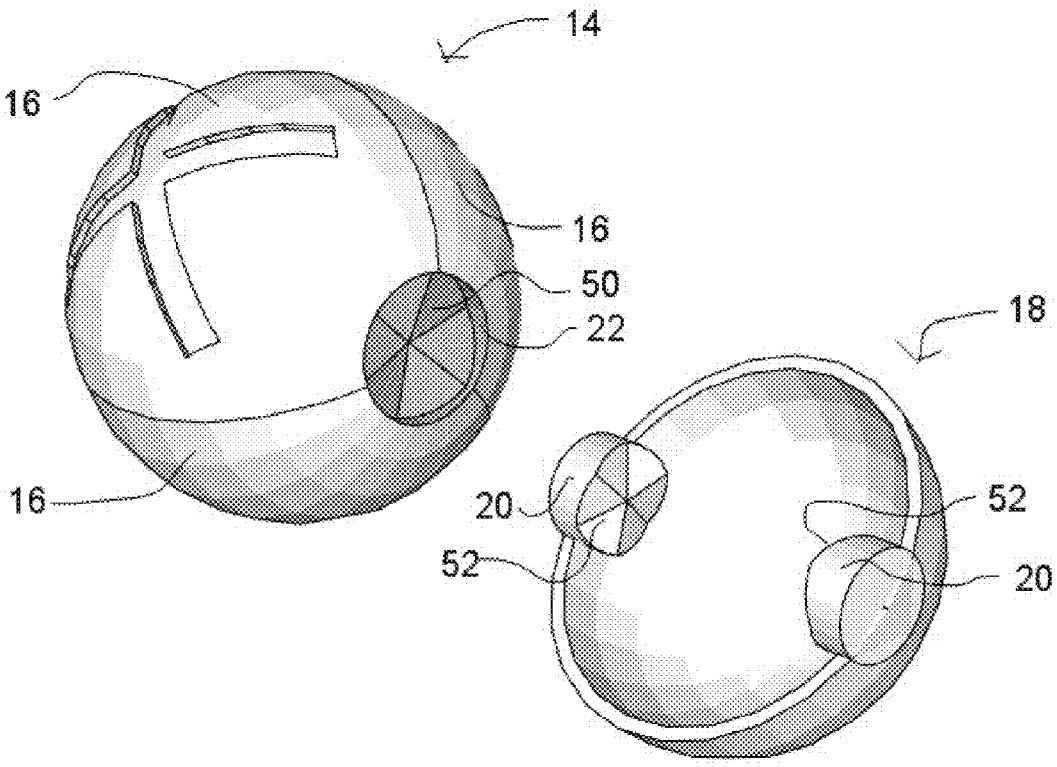
FIG. 4 is an exploded perspective view of a selection unit and a socket in accordance with an example, non-limiting embodiment of the present invention.

As shown in FIGS. 3 and 4, the rotating sphere selector unit 14 is divided into one-third faces 16 that are uniquely identified. The opposing sides of the selector unit 14 have sockets 22 that respectively receive and interact with mating hubs 20 of an inner support frame 18. In this way, the selector units 14 may be mounted for rotation on the inner support frame 18. The sockets 22, which are located at the intersection of the marked faces 16, allow axial sphere rotation and alignment with a corresponding circular aperture 28 in an outer shell wall panel 26 (see FIG. 3). Each side 12 can be clad with an outer shell wall panel 26 through which is a corresponding aperture 28 exposing each selector unit 14 such that only one of the one-third faces 16 is visible.

Figure 1:
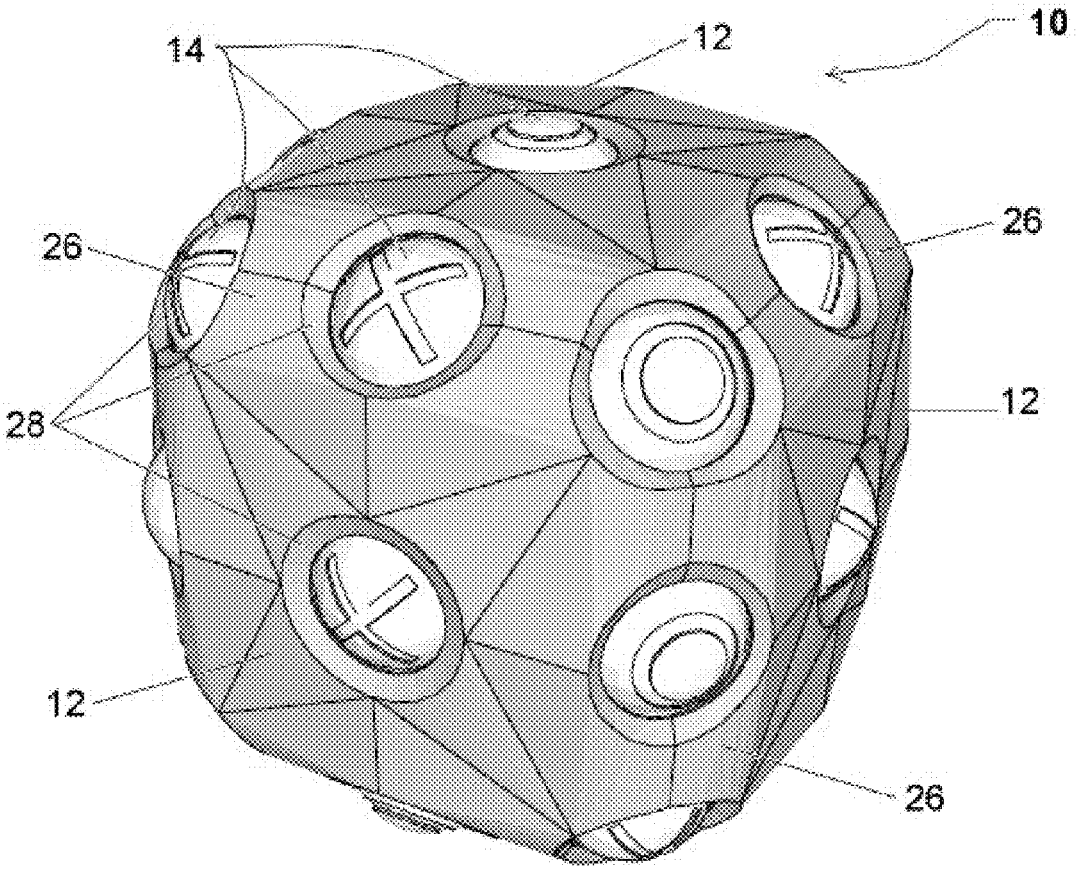
FIG. 1 is a perspective view of a 3D game as a 3 by 3 grid in accordance with an example, non-limiting embodiment of the present invention.
Figure 2:
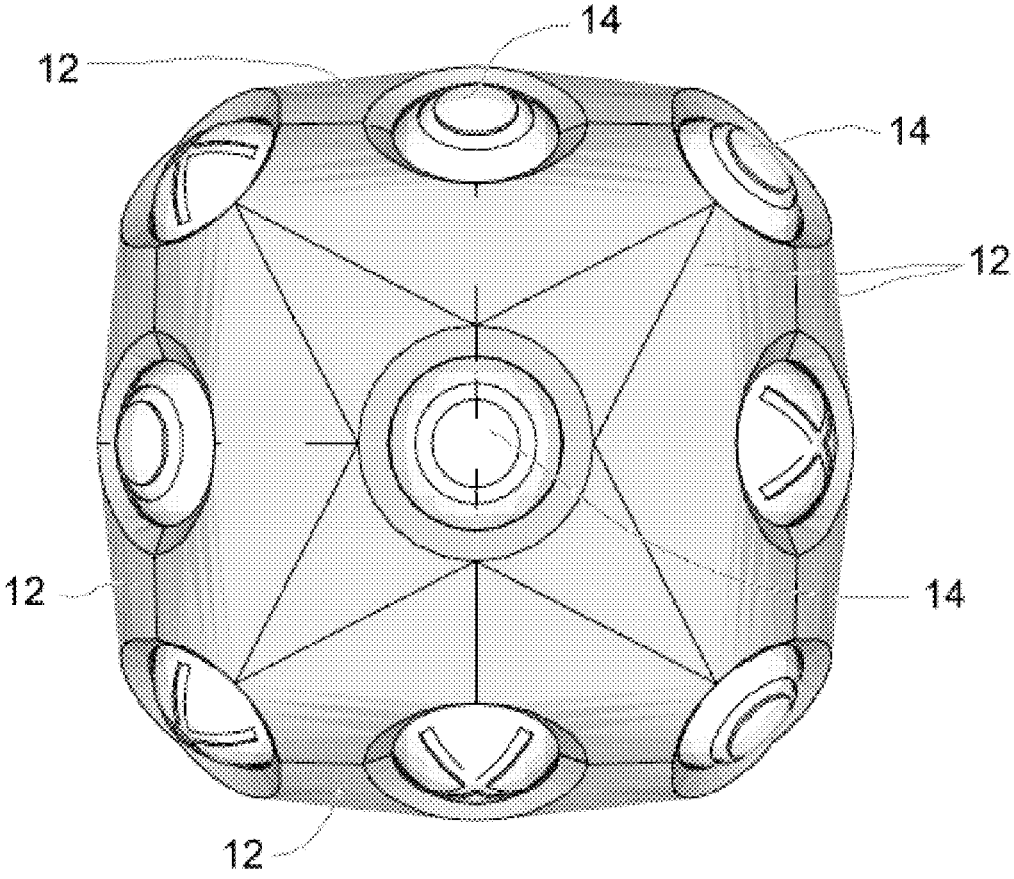
FIG. 2 is a top view of the 3D game in FIG. 1.

With reference to FIG. 1, the 3D game 10 has a cubic form with a grid pattern of rotating sphere selector units 14 recessed into the side, corner and edge loci such that a sufficient portion of the one-third sphere face 16 is exposed enough to protrude through the outer shell wall panel 26 to enable tactile bi-directional rotation.

By way of example only, the selector units 14 may be rotated as follows. From a neutrally marked (or "N" marked) one-third face 16 position, the rotating sphere 14 can be turned in one direction to expose an "X" marked one-third face 16, or in the opposite direction to expose an "O" marked one-third face 16. Returning to the "N" marked one-third face 16 can be accomplished by reversing the initial rotation direction.

Numerous and varied features may be provided to retain the sphere selector unit 14 rotation at each exposed one-third face 16 to prevent a player's position from being changed without sufficient intentional force. As shown in FIG. 4, for example, the socket 22 is in the form of a blind hole. The bottom of the blind hole is provided with detent features 50 that engage (and interact) with corresponding detent features 52 provided on the distal end surfaces of the hubs 20. When the selector unit 14 is in the "N", "X", or "O" position, the detent features on the socket 22 fit between the detent features 52 on the hub 20 to retain the selector unit 14 at that relative rotational position. But with sufficient force, the selector unit 14 can be rotated causing the cooperating detent features 50, 52 to slide past each other. It will be readily apparent that the force required to rotate the selector unit 14 between positions may be adjusted by changing the profiles of the cooperating detent features 50, 52.

With reference to FIG. 3, the cube body can be assembled by snap fitting outer shell wall panels 26 to one another using a suitable interlocking tab 30 along each edge of the panel, and (or) by inserting a stem 32 extending normal to the plane of the panel into a receptor 34 provided in the inner support frame 18. The stem 32 of the panel 26 and the receptor 34 in the inner support frame 18 may be sized to achieve an interference fit. Also, each panel 26 may be provided with four stems 32 as shown in FIG. 3, or more or less than four stems 32.

The 3D game 10 can be sufficiently sized to be compact, hand-held and finger operated. By way of example only, the cubic device can be about 2 to 5 inches in height, width and depth. The portion of rotating sphere 14 which protrudes from the outer shell wall panel 26 can be about ¾ inch in diameter. The rotating sphere 14 loci can be spaced about 1½ inches apart in the grid array. The cube corner and edge loci spheres 14 are situated such that the exposed face 16 can be viewed and manipulated from each confronting and adjacent side 12, enabling rotating spheres at those loci to be "shared" with adjacent sides 12.

The game 10 may be fabricated from high strength plastic or of any other sufficiently rigid and strong material such as metal and the like. Further the various components of the game device can be made of different materials. The rotating sphere 14 exposed face 16 can be molded or treated with a grip-able surface, such as rubber veneer for example. The outer shell wall panel 26 can be printed or embossed with any desired graphic or line-work to enhance the game experience or advance its marketability.

The advantages of the present invention include, without limitation that it is wholly self-contained without the need for additional, loose or detachable parts or pieces and it is exceedingly easy to operate. Because the operable parts are not detached, the present invention is truly portable in that the game can be played while participants are mobile without concern of dropping or losing extraneous game pieces thereby making the game experience more enjoyable as the need to retrieve, find or replace missing parts is eliminated. Further the present invention will appeal to a broader audience of players as choking hazard safety concerns that small detachable pieces might present are non-existent.

By way of example only, the 3D game 10 depicted in FIGS. 1-4 may provide a compact hand-held and self-contained three-dimensional game that permits playing tic-tac-toe on all six sides of the cube simultaneously. But the invention is not limited in this regard. For example, the game may include more or less than six sides of play.

Figure 5:
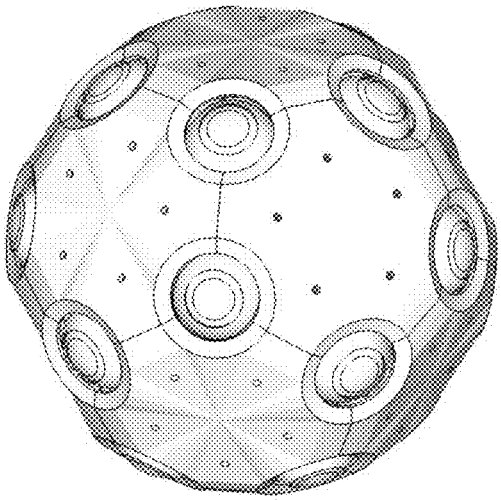
FIG. 5 is a perspective view of a 3D game in accordance with another example, non-limiting embodiment of the present invention.

Consider the example, non-limiting embodiment depicted in FIG. 5. This embodiment is similar to the previous embodiment, except that 12 playing sides are provided. Here, starting with all selector units in the "N" position, the players may take turns rotating the selector units into the "X" or "O" positions until all selector units have been rotated from the "N" position. The winner may be the player that "captures" the most selector units in a line or series.

In the disclosed embodiments, the one-third faces of each selector unit are marked "N" (or blank), "X" or "O". It will be appreciated, however, that numerous and varied indicia may be suitably implemented to uniquely identify the one-third faces. By way of example only, such indicia may include other letters, characters, colors, symbols, surface features, stickers, etc.

In the disclosed embodiments, the selector units have a spherical shape. It will be appreciated, however, that selector units of numerous and varied shapes can be suitably implemented.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiments, methods, and examples, but by all embodiments and methods within the scope and spirit of the invention, including but not limited to a 4×4 (or larger) grid array layout.

What is claimed is:

1. A game comprising:

an inner frame;

a plurality of selector units mounted for rotation on the inner frame; and an outer shell covering the inner frame, the outer shell including a plurality of apertures through which the selector units are respectively exposed;

wherein each selector unit is rotatable relative to the inner frame to expose different portions of the selector unit through a corresponding aperture;

wherein each selector unit includes a pair of sockets respectively receiving opposed hubs provided on the inner frame; and wherein each socket is a blind hole having a bottom provided with detent features that engage with corresponding detent features provided on a corresponding hub to retain a rotational position of the selector unit relative to the inner frame.

2. The game according to claim 1, wherein the selector units have a spherical shape.

3. The game according to claim 1, wherein each selector unit has an outer surface demarcated into three one-third faces that respectively include unique indicia.

4. The game according to claim 3, wherein the unique indicia include an "N", an "X", and an "O" respectively provided on the three one-third faces.

5. A game comprising:

an inner frame;

a plurality of selector units mounted for rotation on the inner frame; and an outer shell covering the inner frame, the outer shell including a plurality of apertures through which the selector units are respectively exposed;

wherein each selector unit is rotatable relative to the inner frame to expose different portions of the selector unit through a corresponding aperture;

wherein the outer shell has at least six sides facing in different directions;

wherein each side includes at least one of the apertures through which a corresponding selector unit is exposed;

wherein two sides meet at a line of intersection; and wherein at least one of the apertures is located along the line of intersection for exposing a corresponding selector unit.

6. The game according to claim 5, wherein the sides are planar.

7. The game according to claim 5, wherein the outer shell has at least three sides that meet at an apex; and wherein one of the apertures is located at the apex for exposing a corresponding selector unit.

8. A game comprising:

a body bounded by a plurality of playing surfaces that face in different directions;

a plurality of supports provided on the inside of the body and covered by the playing surfaces; and a plurality of selector units respectively mounted on the supports for rotation relative to the body;

wherein the body includes apertures through which the selector units are respective exposed;

wherein each selector unit includes a pair of sockets;

wherein each support includes a pair of opposed hubs;

wherein the sockets respectively receive the hubs; and wherein each socket is a blind hole having a bottom provided with detent features that engage with corresponding detent features provided on a corresponding hub to retain a rotational position of the selector unit relative to the body.

9. The game according to claim 8, wherein the selector units have a spherical shape.

10. The game according to claim 8, wherein each selector unit has an outer surface demarcated into three one-third faces that respectively include unique indicia.

11. The game according to claim 10, wherein the unique indicia include an "N", an "X", and an "O" respectively provided on the three one-third faces.

12. A game comprising:

a body bounded by a plurality of playing surfaces that face in different directions;

a plurality of supports provided on the inside of the body and covered by the playing surfaces; and a plurality of selector units respectively mounted on the supports for rotation relative to the body;

wherein the body includes apertures through which the selector units are respectively exposed;

wherein the body has at least six playing surfaces;

wherein each playing surface includes at least one of the apertures through which a corresponding selector unit is exposed;

wherein two playing surfaces meet at a line of intersection; and wherein at least one of the apertures is located along the line of intersection for exposing a corresponding selector unit.

13. The game according to claim 12, wherein the playing surfaces are planar.

14. The game according to claim 12, wherein the body has at least three playing surfaces that meet at an apex; and wherein one of the apertures is located at the apex for exposing a corresponding selector unit.

* * * * *